US007466944B2

(12) United States Patent
Bessho

(10) Patent No.: US 7,466,944 B2
(45) Date of Patent: Dec. 16, 2008

(54) DEVELOPING DEVICE FOR DEVELOPING IMAGES BY ADHERING DEVELOPER ONTO ELECTROSTATIC IMAGES

(75) Inventor: Yuji Bessho, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 83 days.

(21) Appl. No.: 11/609,720

(22) Filed: Dec. 12, 2006

(65) Prior Publication Data

US 2007/0134025 A1 Jun. 14, 2007

(30) Foreign Application Priority Data

Dec. 13, 2005 (JP) ..... 2005-359625

(51) Int. Cl.
*G03G 15/08* (2006.01)
*G03G 15/09* (2006.01)

(52) U.S. Cl. ..... 399/254; 399/269

(58) Field of Classification Search ..... 399/254, 399/256, 269; 222/DIG. 1; 366/241
See application file for complete search history.

(56) References Cited

U.S. PATENT DOCUMENTS 4,940,014 A * 7/1990 Saijo et al. ..... 399/256
6,259,876 B1 * 7/2001 Fukuda et al. ..... 399/254
6,975,825 B2 * 12/2005 Sakamaki et al. ..... 399/269
2007/0025773 A1 * 2/2007 Tateyama et al. ..... 399/254

FOREIGN PATENT DOCUMENTS

JP 5-333691 12/1993
JP 6-51634 2/1994

* cited by examiner

*Primary Examiner*—Sophia S Chen
(74) *Attorney, Agent, or Firm*—Canon USA Inc IP Div

(57) ABSTRACT

A developing device includes a developer-bearing member supporting developer for developing electrostatic images, a first chamber supplying the developer to the developer-bearing member, a second chamber below the first chamber, first and second communicating portions connecting the first and second chambers, a first carrying member carrying the developer in the first chamber in a first direction from the first communicating portion to the second communicating portion, a second carrying member carrying the developer in the second chamber in a second direction from the second communicating portion to the first communicating portion, and a partition between the first and second chambers. A bottom portion of the first chamber is inclined such that a downstream end thereof in the first direction is higher than the other end at a position where the bottom portion faces the developer-bearing member.

8 Claims, 12 Drawing Sheets

DEVELOPING DEVICE FOR DEVELOPING IMAGES BY ADHERING DEVELOPER ONTO ELECTROSTATIC IMAGES

BACKGROUND OF THE INVENTION

1. Field of the Invention

The present invention relates to developing devices for turning electrostatic images formed on image-bearing members into visible images by adhering developer to the electrostatic images.

2. Description of the Related Art

In image-forming apparatuses employing an electrophotographic recording method such as copying machines, electrostatic images formed on image-bearing members such as photosensitive drums are turned into visible images by adhering developer to the electrostatic images. For such development, developing devices using two-component developer including a toner and a carrier are well known. An example of such developing devices is shown in FIG. 8. FIG. 8 is a schematic cross-sectional view of a developing device according to a known technology.

A developing device 101 using a two-component developer shown in FIG. 8 often includes two horizontally disposed screws, a first carrying screw 105 and a second carrying screw 106, that carry the two-component developer while agitating the developer. The first carrying screw 105 supplies the developer to a developer-bearing member (referred to as a "developing sleeve") 108, and collects the developer after passing through a developing area A where the developing sleeve 108 faces a photosensitive drum 110.

Moreover, the second carrying screw 106 agitates the developer collected from the developing sleeve 108 and newly supplied developer so as to mix the developers.

A bristle-cutting member 109 regulates the length of bristles of the developer supported on the developing sleeve 108 in a developing container 102.

On the other hand, a demand for small image-forming apparatuses employing the electrophotographic recording method such as copying machines and printers has been increasing in recent years to enable space saving. In particular, a demand for small full-color image-forming apparatuses that use a plurality of developing devices is high.

Therefore, for example, developing devices disclosed in Japanese Patent Laid-Open Nos. 5-333691 and 6-51634 are well known.

First, the developing device disclosed in Japanese Patent Laid-Open No. 5-333691 will be described with reference to FIGS. 9 to 12.

FIG. 9 is a transverse sectional view of a developing device 101 in a direction perpendicular to a direction of axes of a developing sleeve 108 and carrying screws 105 and 106, whereas FIG. 10 is a longitudinal sectional view in the axial direction.

The developing device 101 of a vertical agitating type shown in FIG. 9 is peculiar in that it has two vertically disposed carrying screws 105 and 106 for agitating and carrying developer.

More specifically, the developing device 101 includes a container 102 containing the developer, and includes the developing sleeve 108 disposed at an opening of the container 102, the opening facing a photosensitive drum 110. A developing chamber 103 and an agitating chamber 104 that are separated by a partition 107 are vertically disposed in the container 102 at a side opposite to the side of the opening. The first carrying screw 105 and the second carrying screw 106 are disposed in the developing chamber 103 and the agitating chamber 104, respectively, so as to agitate and carry the developer.

The first carrying screw 105 carries the developer in the developing chamber 103. Moreover, the second carrying screw 106 carries toner, which is newly supplied from a toner inlet disposed upstream of the second carrying screw 106, to the agitating chamber 104, and the developer already existing in the agitating chamber 104, while agitating the toner and the developer so as to homogenize the toner density of the developer.

As described above, the developing device 101 of the vertical agitating type shown in FIG. 9 has the developing chamber 103 and the agitating chamber 104 that are vertically disposed, and thus the occupied space in the horizontal direction is advantageously small. Therefore, a small color-image-forming apparatus of a tandem type having a plurality of developing devices disposed in parallel in the horizontal direction, for example, can also be realized.

Furthermore, the developing device of the vertical agitating type also has the following advantages.

That is, as shown in FIG. 9, the developer in the developing chamber 103 is carried to the developing area A while being supported on the developing sleeve 108, and then used for development. Subsequently, the remaining developer that is not used for the development in the developing area A is collected at the agitating chamber 104 in connection with the rotation of the developing sleeve 108 instead of the developing chamber 103. Therefore, the developing chamber 103 always contains only the developer that has been sufficiently agitated in the agitating chamber 104.

Thus, the developing sleeve 108 is always supplied with the developer having uniform density, and uniform images without unevenness and density difference in a direction parallel to the rotational axis (thrust direction) caused by insufficient agitation can be obtained.

The above-described developing device 101 of the vertical agitating type has advantages in that the developing device is suitable for a reduction in size and the unused developer can be returned to the agitating chamber as described above. However, the following problems exist.

That is, as shown in FIG. 10, the first carrying screw 105 is disposed in the bottom portion of the developing chamber 103 so as to be substantially parallel to the axis of the developing sleeve 108. The screw 105 carries the developer in the developing chamber 103 in one direction along the axis thereof by rotation.

Moreover, the second carrying screw 106 is disposed in the bottom portion of the agitating chamber 104 so as to be substantially parallel to the first carrying screw 105. The screw 106 carries the developer in the agitating chamber 104 in a direction opposite to the carrying direction of the first carrying screw 105.

In this manner, the rotations of the first carrying screw 105 and the second carrying screw 106 circulate the developer between the developing chamber 103 and the agitating chamber 104 via openings 111 and 112 provided at either end of the partition 107.

In this developing device 101, the developing chamber 103 and the agitating chamber 104 are disposed in the vertical direction. Therefore, the developer is moved downward from the developing chamber 103 to the agitating chamber 104, and is moved upward from the agitating chamber 104 to the developing chamber 103 as shown in FIG. 10.

In particular, the developer is delivered from the agitating chamber 104 to the developing chamber 103 such that the developer is pushed upward by the pressure of the developer that is accumulated at the end portion. A circulation route of the developer at this time is shown in FIG. 11.

As shown in FIG. 11, all the developer delivered from the agitating chamber 104 to the developing chamber 103 does not reach the downstream end of the first carrying screw 105 in the developing chamber 103. Some components of the developer are supplied to the developing sleeve 108 along the route, and collected in the agitating chamber 104 after passing through the developing area. Routes of these components are shown by arrows B in FIG. 11.

The supply of the developer to the developing sleeve 108 is performed over approximately the entire width of the developing sleeve 108. Therefore, as shown in FIG. 10, the amount of developer carried by the first carrying screw 105 in the developing chamber 103 tends to be gradually reduced from the upstream end to the downstream end. On the other hand, the amount of developer carried by the second carrying screw 106 in the agitating chamber 104 tends to be gradually increased from the upstream end to the downstream end. That is, the distribution of the developer in the developing device 101 is uneven.

In particular, when the developer is unevenly distributed in the developing chamber 103, the supply of developer to the developing sleeve 108 becomes uneven, and this unevenness causes a difference in density in images in the axial direction of the developing sleeve 108. That is, the density in images in the upstream region of the carrying route in the developing chamber where a sufficient amount of developer is supplied stays constant due to the stable supply of developer to the developing sleeve 108. However, images in the downstream region of the carrying route in the developing chamber where a sufficient amount of developer is not supplied are degraded due to the density unevenness of the images caused by the insufficient supply of the developer to the developing sleeve 108.

FIG. 12 illustrates a developing device having a developing chamber and an agitating chamber as in the developing device 101 shown in FIG. 9 and two developing sleeves. In this type of developing device, it is ideal that the developer supplied from a developing chamber 103 to an upper developing sleeve 108*a* be transferred from the upper developing sleeve 108*a* to a lower developing sleeve 108*b*, and the developer removed from the lower developing sleeve 108*b* be supplied to an agitating chamber 104. Subsequently, the developer supplied to the developing chamber 103 via a route similar to that described above is supplied again from the developing chamber 103 to the upper developing sleeve 108*a*.

However, when the developer is unevenly distributed in the agitating chamber 104, in the developing device 101 shown in FIG. 12, the developer may be supplied from the agitating chamber 104 to the lower developing sleeve 108*b* in a direction of an arrow C shown in FIG. 12 at a position where the developer surface in the agitating chamber 104 is high, i.e., in the downstream region of the carrying route in the agitating chamber.

Contrary to the ideal flow of the developer, an excessive amount of developer is supplied to the lower developing sleeve 108*b* at the above-described position when a flow in the direction of the arrow C is generated. This may lead to an unevenness of density in images, and thus lead to degradation of the images.

In order to solve the above-described problem, the carrying capacity of the developer of the first carrying screw 105 and the second carrying screw 106 may be sufficiently increased as compared with the amount of the developer supplied to the developing sleeve 108*a* such that the unevenness of the developer is relatively reduced as in the known technology disclosed in Japanese Patent Laid-Open No. 5-333691. However, when the amount of developer to be carried is increased, by increasing the rotational speed of the first carrying screw 105 and the second carrying screw 106, stress and torque to the developer are increased. Thus, the amount of developer to be carried cannot be significantly increased.

Moreover, increasing the carrying speed by improving the pitch, shape, or the like of the carrying screws is also ineffective due to the upper limit of the carrying speed when the distribution of the developer is markedly uneven.

The known technology disclosed in Japanese Patent Laid-Open No. 6-51634 provides another solution to the above-described problems. That is, the technology includes a third carrying screw 113 shown in FIG. 9 indicated by alternate long and short dash lines. The third carrying screw 113 is disposed between the developing sleeve 108 and the second carrying screw 106 in the agitating chamber 104 so as to smooth the unevenness of the developer. However, the structure of the developing device becomes complicated in this case, and leads to an increase in cost.

SUMMARY OF THE INVENTION

The present invention is directed to a developing device capable of reducing unevenness of developer in the developing device.

According to one aspect of the present invention, a developing device includes a developing container that accommodates developer; a rotatable developer-bearing member disposed in the developing container and supporting the developer for developing electrostatic images; a first chamber provided in the developing container for supplying the developer to the developer-bearing member; a second chamber provided in the developing container below the first chamber; a partition disposed between the first chamber and the second chamber; a first communicating portion disposed at one end of the first chamber and the second chamber in the longitudinal direction and connecting the first chamber and the second chamber; a second communicating portion disposed at the other end of the first chamber and the second chamber in the longitudinal direction and connecting the first chamber and the second chamber; a first carrying member disposed in the first chamber and configured to carry the developer in the first chamber in a first carrying direction from the first communicating portion to the second communicating portion; and a second carrying member disposed in the second chamber and configured to carry the developer in the second chamber in a second carrying direction from the second communicating portion to the first communicating portion. A bottom portion of the first chamber is inclined such that an end of the bottom portion to the downstream end in the first carrying direction is higher than the other end at a position where the bottom portion faces the developer-bearing member.

Further features of the present invention will become apparent from the following description of exemplary embodiments with reference to the attached drawings.

DESCRIPTION OF THE EMBODIMENTS

Exemplary embodiments of the present invention will now be described with reference to the drawings. However, the dimensions, materials, shapes, relative arrangements, and the like of components described in the exemplary embodiments do not limit the scope of the present invention unless otherwise specified.

An image-forming apparatus that forms full-color images is described as an example of image-forming apparatuses in the description below. However, the developing device according to the present invention is not applied only to such image-forming apparatuses.

First Exemplary Embodiment

An image-forming apparatus and a developing device according to a first exemplary embodiment of the present invention will now be described with reference to FIGS. 1 to 3C.

Figure 1:
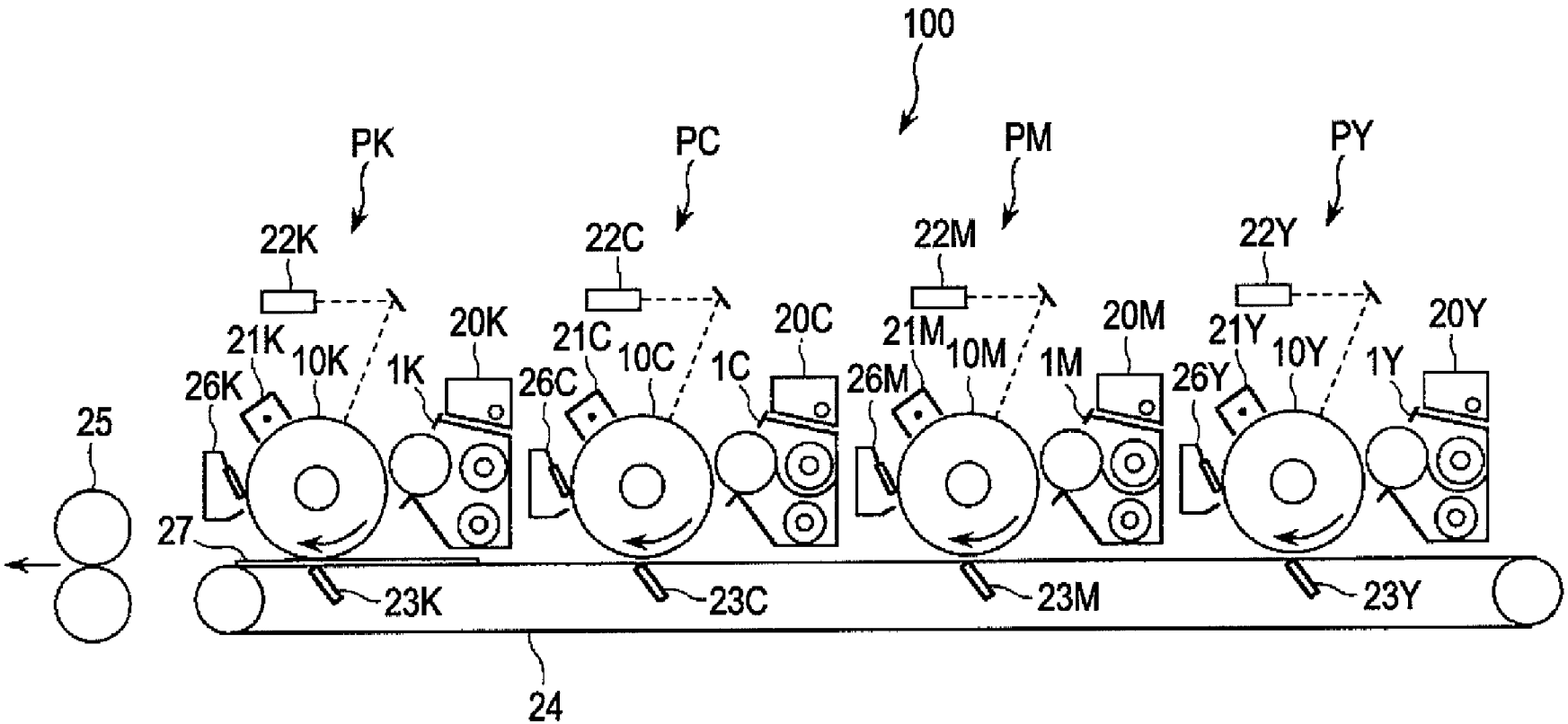
FIG. 1 is a schematic view of an image-forming apparatus according to a first exemplary embodiment of the present invention.
Figure 2:
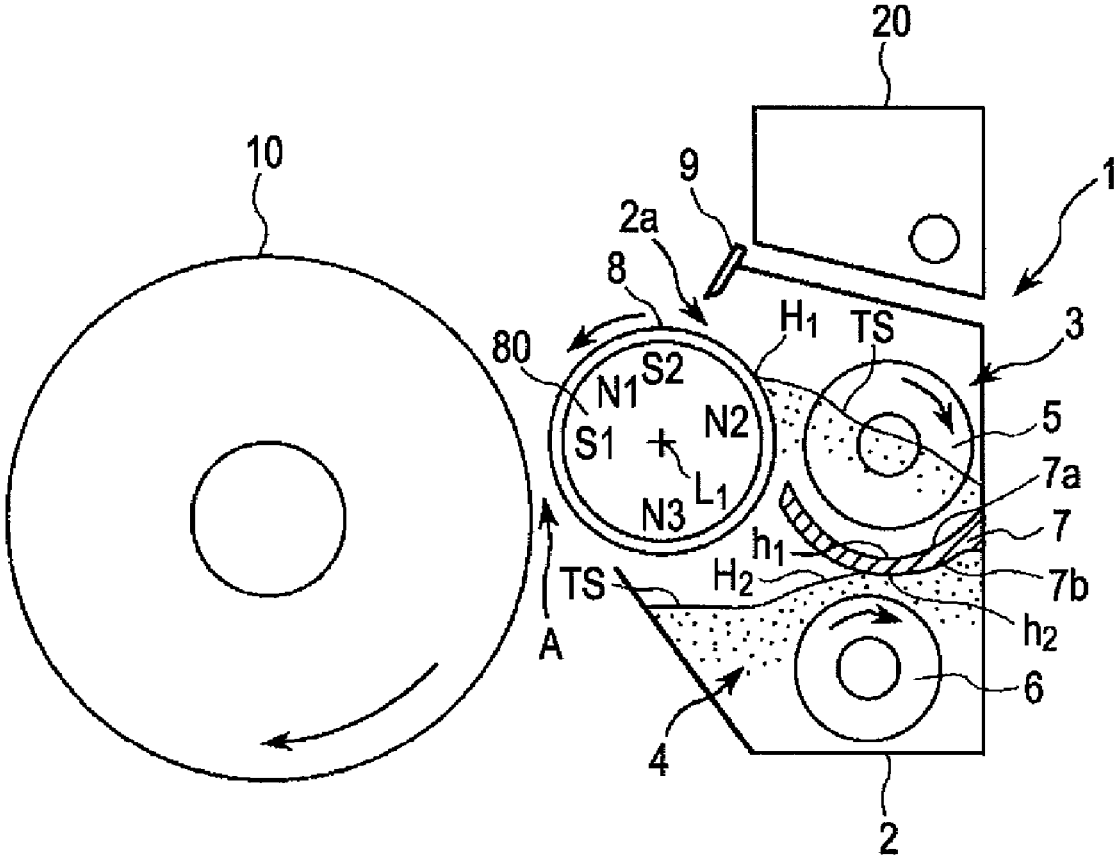
FIG. 2 is a schematic transverse sectional view of a developing device according to the first exemplary embodiment of the present invention.
Figure 3A:
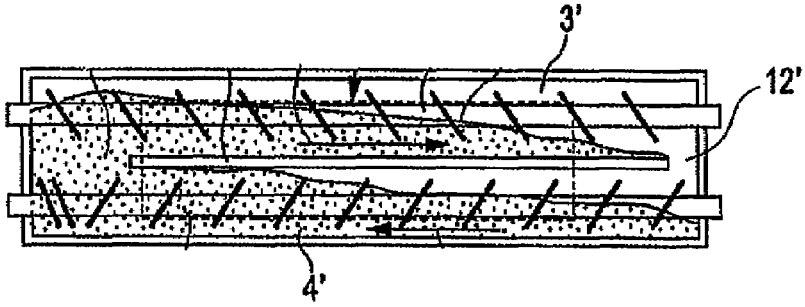
FIG. 3A PRIOR ART
FIG. 3A is a schematic longitudinal sectional view of a known developing device.
Figure 3B:
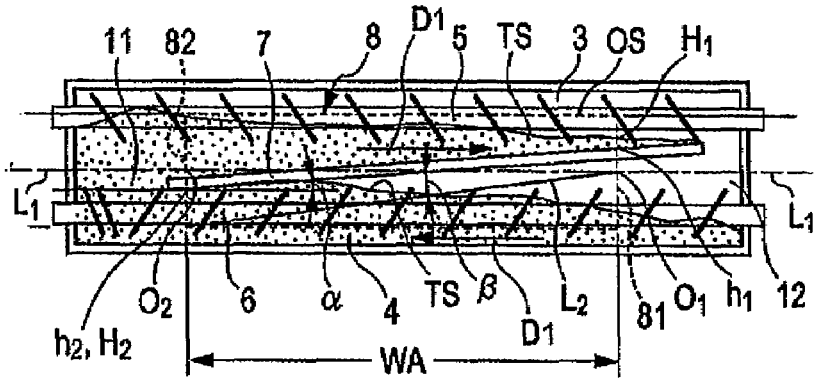
FIG. 3B is a schematic longitudinal sectional view of the developing device according to the first exemplary embodiment of the present invention.
Figure 3C:
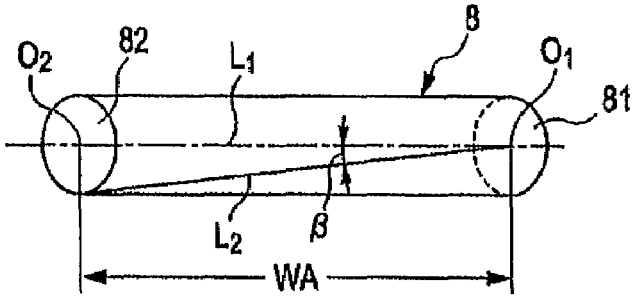
FIG. 3C is a perspective view of a developing device.

First, a schematic structure of an image-forming apparatus and developing devices will be described with reference to FIGS. 1 and 2. FIG. 1 is a schematic view of the image-forming apparatus according to the first exemplary embodiment of the present invention. FIG. 2 is a transverse sectional view of one of the developing devices according to the first exemplary embodiment of the present invention. FIGS. 3A to 3C are longitudinal sectional views of one of the developing devices.

FIG. 1 schematically illustrates drum-shaped electrophotographic photosensitive members (hereinafter referred to as photosensitive drums) serving as image-bearing members and the developing devices included in the body of the image-forming apparatus.

A full-color image-forming apparatus 100 including a plurality of image-forming stations P as shown in FIG. 1 is well known. In this exemplary embodiment, for example, the image-forming stations P (PY, PM, PC, and PK) are provided for four colors of yellow (Y), magenta (M), cyan (C), and black (K). FIG. 2 mainly illustrates one of the developing devices in the corresponding image-forming station P.

The image-forming stations P (PY, PM, PC, and PK) have substantially the same structure, and form images of Y, M, C, and K, respectively, during formation of full-color images.

In the description below, the term "developing device 1" indicates one of commonly provided developing devices 1Y, 1M, 1C, and 1K in the image-forming stations P (PY, PM, PC, and PK) for Y, M, C, and K, respectively. Similarly, characters Y, M, C, and K are added to reference numbers of common components shown in FIG. 1, but the descriptions thereof will be omitted.

First, the structure and operations of the entire image-forming apparatus will be described with reference to FIG. 1.

A photosensitive drum 10 serving as an image-bearing member is rotatable, and the surface of the photosensitive drum 10 (10Y, 10M, 10C, 10K) is uniformly charged by a primary charging device 21Y, 21M, 21C, 21K serving as a charging unit. Subsequently, the uniformly charged surface of the photosensitive drum 10 is exposed to light that is modulated according to information signals using a light-emitting device 22Y, 22M, 22C, 22K serving as a latent-image-forming unit such as a laser such that electrostatic latent images are formed. The electrostatic latent images formed in this manner are turned into visible toner images by the developing device 1.

Next, the visible images are transfeffed to a recording paper 27 serving as a recording material. The paper 27 is carried on a recording-paper-carrying belt 24 serving as a recording-material-bearing member. The images are transferred to the paper 27 using a charging device 23Y, 23M, 23C, 23K. Toner images transferred to the recording paper 27 are fixed on the paper using a fixing device 25 so as to become permanent images. Moreover, the toner remaining on the photosensitive drum 10 after the transfer operation is removed by a cleaning device 26Y, 26M, 26C, 26K. Moreover, an amount of toner consumed in the image formation is supplied from a toner tank 20 (20Y. 20M, 20C, 20K).

Next, operations of the developing device 1 will be described with reference to FIGS. 2 to 3C.

The developing device 1 according to this exemplary embodiment includes a developing container 2 that accommodates a two-component developer containing a non-magnetic toner and a magnetic carrier. The developing device 1 includes a developing sleeve 8 serving as a developer-bearing member that develops a developing area by applying the developer, and a bristle-cutting member 9 for regulating the length of bristles of the developer supported on the developing sleeve 8 in the developing container 2. The developing container 2 is vertically divided into a developing chamber 3 and an agitating chamber 4 by a partition 7 extending in a direction perpendicular to the direction of the side view shown in FIG. 1, i.e., extending parallel to the rotational axis of the developing sleeve 8 at the substantially intermediate position of the developing container 2. The developer is accommodated in the developing chamber 3 and the agitating chamber 4.

The developing chamber 3 includes a first carrying screw 5 serving as a developer-carrying member, and the agitating chamber 4 includes a second carrying screw 6 serving as a developer-agitating member. In this exemplary embodiment, the first carrying screw 5 and the second carrying screw 6 are rotated in directions of arrows shown in FIG. 2, but the rotating directions are not limited to these.

The first carrying screw 5 is disposed in the bottom portion of the developing chamber 3 so as to be substantially parallel to the rotational axis of the developing sleeve 8, and carries the developer in the developing chamber 3 in one direction along the axis line thereof by rotation.

Moreover, the second carrying screw 6 is disposed in the bottom portion of the agitating chamber 4 so as to be substantially parallel to the first carrying screw 5, and carries the developer in the agitating chamber 4 in a direction opposite to the carrying direction of the first carrying screw 5.

In this manner, the rotation of the first carrying screw 5 and the second carrying screw 6 circulates the developer between the developing chamber 3 and the agitating chamber 4 via an opening 11 serving as a first communicating portion and an opening 12 serving as a second communicating portion provided at either end of the partition 7 in the longitudinal direction.

Furthermore, an opening 2*a* is provided at a position where the developing container 2 faces the photosensitive drum 10, i.e., in a developing area A such that the rotatable developing sleeve 8 is partly exposed to the photosensitive drum 10. The developing sleeve 8 is composed of a non-magnetic material, and includes a non-rotary magnetic roller 80 serving as a magnetic-field-generating unit inside the developing sleeve 8. This magnetic roller 80 includes a magnetic pole S1 for development and magnetic poles N1, S2, N2, and N3 for carrying the developer.

With this structure, the developing sleeve 8 is rotated in a direction of an arrow shown in the drawing, i.e., in the same direction as that of the photosensitive drum 10 in the developing area A during development. The layer thickness of the developer supported and carried on the developing sleeve 8 is regulated by cutting the bristles of magnetic brushes using the bristle-cutting member 9 serving as a developer-thickness-regulating member attached to the developing container 2. The two-component developer after regulating the layer thickness is supported on the developing sleeve 8, and carried to the developing area A where the developing sleeve 8 faces the photosensitive drum 10. The developer is supplied to the electrostatic images formed on the photosensitive drum 10 such that the electrostatic images are developed. At this time, a developing bias generated by superposing a DC voltage and an AC voltage is applied from a power source to the developing sleeve 8 in order to improve the developing efficiency, i.e., the rate of toner applied to the electrostatic images.

The bristle-cutting member 9 can be composed of a non-magnetic material such as aluminum, and is disposed further upstream in the rotational direction of the developing sleeve 8 than the photosensitive drum 10 so as to face the magnetic pole S2 of the magnetic roller 80. The developer (both the non-magnetic toner and the magnetic carrier) passes between an end portion of the bristle-cutting member 9 and the developing sleeve 8, and is supplied to the developing area A.

The amount by which the bristles of the magnetic brushes of the developer supported on the developing sleeve 8 are cut is controlled by changing the size of the gap between the bristle-cutting member 9 and the surface of the developing sleeve 8. Thus, the amount of developer carried to the developing area A can be adjusted.

The first carrying screw 5 is disposed in the bottom portion of the developing chamber 3 so as to be substantially parallel to the axis of the developing sleeve 8 (in a direction along the developing width). In this exemplary embodiment, the first carrying screw 5 employs a screw structure that includes non-magnetic blade members disposed around the ferromagnetic rotary shaft in a helical manner. The developer in the developing chamber 3 is carried along the axis of the developing sleeve 8 in the bottom portion of the developing chamber 3 by the rotation of the first carrying screw 5.

Moreover, the second carrying screw 6 also employs a screw structure that includes blade members disposed around the rotary shaft in a helical manner as in the first carrying screw 5, the direction of the blades being opposite to that in the first carrying screw 5. The second carrying screw 6 is disposed in the bottom portion of the agitating chamber 4 so as to be substantially parallel to the first carrying screw 5, and is rotated in the same direction as the first carrying screw 5 so as to carry the developer in the agitating chamber 4 in the direction opposite to the carrying direction of the first carrying screw 5.

In this manner, the rotations of the first carrying screw 5 and the second carrying screw 6 circulate the developer between the developing chamber 3 and the agitating chamber 4 via the openings 11 and 12 provided at either end of the partition 7.

Since the developing chamber 3 and the agitating chamber 4 in the developing device 1 according to this embodiment are vertically disposed, the developer falls downward from the developing chamber 3 to the agitating chamber 4 via the opening 12, and flows upward from the agitating chamber 4 to the developing chamber 3 via the opening 11. In particular, the developer is delivered from the agitating chamber 4 to the developing chamber 3 such that the developer is pushed upward by the pressure of the developer that is accumulated at the end portion. Arrows D1 shown in FIG. 3B indicate the carrying direction of the developer in the developing chamber 3 and the agitating chamber 4 at this time.

As described in the known technologies, all the developer delivered from the agitating chamber 4 to the developing chamber 3 does not reach the downstream end of the first carrying screw 5 in the developing chamber 3. Some components of the developer are supplied to the developing sleeve 8 along the route, and collected in the agitating chamber 4 after passing through the developing area A. The supply of the developer to the developing sleeve 8 is performed in a space between both ends 81 and 82 in the longitudinal direction of the developing sleeve 8, i.e., approximately in the entire developing area WA of the developing sleeve 8 in the longitudinal direction.

Therefore, the amount of developer carried by the first carrying screw 5 in the developing chamber 3 tends to be gradually reduced from the upstream end to the downstream end. On the other hand, the amount of the developer carried by the second carrying screw 6 in the agitating chamber 4 tends to be gradually increased from the upstream end to the downstream end.

That is, the distribution of the developer in the developing device is uneven. In particular, when the developer is unevenly distributed in the developing chamber 3, the supply of the developer to the developing sleeve 8 becomes uneven, and this unevenness causes degradation of images such as a difference in density in images in the axial direction of the developing sleeve 8.

Therefore, the partition 7 that divides the developing container 2 into the developing chamber 3 and the agitating chamber 4 is inclined such that a downstream end in the carrying direction of the developer using the first carrying screw 5 in the developing chamber 3 becomes higher than the other end in this exemplary embodiment. Thus, the unevenness of distribution of the developer can be reduced. This will be described in detail with reference to FIGS. 3A to 3C. FIG. 3A is a schematic cross-sectional view of a known developing device, and FIG. 3B is a schematic cross-sectional view of the developing device according to the first exemplary embodiment of the present invention.

In this exemplary embodiment (FIG. 3B), the circulation of the developer in the developing container differs from that in the known technology (FIG. 3A) in the following point.

As shown in the drawings, the partition 7 in the developing device according to this exemplary embodiment is inclined such that the downstream end in the carrying direction of the developer in the developing chamber 3 becomes higher than the other end. This inclination forms a mechanism for regulating the unevenness of distribution of the developer.

With the structure according to this exemplary embodiment, the developer surface TS in the carrying route in the developing chamber 3 becomes higher than that of the known technology.

As described above, the developer supplied from the agitating chamber 4 is carried by the first carrying screw 5 in the developing chamber 3 while being gradually supplied to the developing sleeve 8, and falls into the agitating chamber 4 via the opening 12 at the downstream end so as to be circulated.

In the known developing device, almost all of the developer carried to the downstream end of the carrying route in a developing chamber 3' falls into an agitating chamber 4' via an opening 12' as shown in FIG. 3A. Therefore, the amount of the developer in the downstream region in the developing chamber 3' is small, resulting in uneven distribution of the developer in the developing chamber 3'.

In contrast, in this exemplary embodiment, the partition 7 between the developing chamber 3 and the agitating chamber 4 is inclined such that the downstream end in the carrying direction of the developer in the developing chamber 3 becomes higher than the other end as shown in FIG. 3B. With this, the developer is subjected to a carrying force in the direction opposite to the carrying direction of the first carrying screw 5 in the developing chamber 3 due to the inclination of the partition 7 in addition to a carrying force applied by the first carrying screw 5. Moreover, the position of the downstream end of the developing chamber is raised with respect to the developing sleeve 8. Thus, the surface TS of the developer carried downstream of the developing chamber is raised compared with that in the known technology, and the unevenness of the distribution of the developer in the thrust direction can also be reduced.

Therefore, according to this exemplary embodiment, the developer surface TS in the developing chamber 3, the developer being carried from the developing chamber 3 to the agitating chamber 4 via the opening 12, can be raised as compared with that in the known technology, and a sufficient amount of developer in the downstream region in the carrying direction can be ensured. Thus, the unevenness of the distribution of the developer in the developing chamber 3 can be reduced as shown in FIG. 3B.

The inclination of the developer surface TS can be adjusted using the inclination of the partition 7 with respect to level, i.e., an angle $\alpha$ of inclination. Effects of the present invention are small when the angle $\alpha$ is small, whereas the carrying performance in the developing chamber 3 is impaired when the angle $\alpha$ is made too large.

According to investigation by the inventors, a range of the angle $\alpha$ can be from 1° to 15°. Further, the angle $\alpha$ can be smaller than or equal to an angle $\beta$ shown in FIGS. 3B and 3C. The angle $\beta$ is an angle between a central axis line $L_1$ passing through centers $O_1$ and $O_2$ of the developing sleeve 8 in use at the ends 81 and 82, respectively, and a diagonal line $L_2$ formed by connecting the center $O_1$ at the end 81 of the developing sleeve 8 with the most external periphery at the end 82 (alternatively, connecting the center $O_2$ at the end 82 with the most external periphery at the end 81). When the angle $\alpha$ is larger than the angle $\beta$, the carrying performance in the agitating chamber is impaired, and at the same time, the developer removed from the sleeve is not appropriately collected. This may cause an overflow of the developer.

The ends 81 and 82 of the developing sleeve 8 in this exemplary embodiment do not necessarily mean the end portions of the developing sleeve 8 in the longitudinal direction, but can mean end faces that define the maximum developer-supporting area WA of the developing sleeve 8 in the longitudinal direction as described above. The maximum developer-supporting area in the longitudinal direction means the maximum length in the longitudinal direction by which the developer can be supported.

Moreover, as clearly shown in FIGS. 2 to 3C, the effect of the developing device according to this exemplary embodiment can be further enhanced by using the structure detailed below. That is, a vertical position $H_1$ of the developer surface TS at the downstream end 81 of the developing sleeve 8 in the carrying direction of the developer in the developing chamber 3 can be located above the central axis line $L_1$ of the developing sleeve 8.

In general, the developer surface TS in the developing chamber 3 is inclined in the transverse sectional direction in the developing chamber 3 as shown in FIG. 2 due to the rotation of the first carrying screw 5. Therefore, a position where the developer is in contact with the developing sleeve 8 at the downstream end 81 of the developing sleeve 8 is defined as the position $H_1$ in this exemplary embodiment.

Furthermore, a vertical position $h_1$ of the partition 7 at the end 81 of the developing sleeve 8 can be located above the central axis line $L_1$ of the developing sleeve 8, and at the same time, located below a position OS at the top of the external surface of the developing sleeve 8. When the position $h_1$ is located above the position OS, the supply of the developer to the developing sleeve 8 is hindered, and the distribution of the developer on the developing sleeve becomes uneven in the thrust direction, thereby causing degradation of images (unevenness of density in images).

Furthermore, the effect of the developing device according to this exemplary embodiment can be further enhanced by using the structure detailed below. That is, a vertical position $H_2$ of the developer surface TS at the downstream end 82 of the developing sleeve 8 in the carrying direction of the developer in the agitating chamber 4 can be located below the central axis line $L_1$ of the developing sleeve 8.

In general, the developer surface TS in the agitating chamber 4 is also inclined in the transverse sectional direction in the agitating chamber 4 as shown in FIG. 2 due to the rotation of the second carrying screw 6. Therefore, the highest position of the developer at the downstream end 82 of the developing sleeve 8 is defined as the position $H_2$ in this exemplary embodiment.

Furthermore, a vertical position $h_2$ of the partition 7 at the end 82 of the developing sleeve 8 can be located below the central axis line $L_1$ of the developing sleeve 8. With this, less developer in the agitating chamber is attracted to the magnetic poles in the developing sleeve, and thus the unevenness of the developer on the developing sleeve can be further prevented.

Herein, the positions $h_1$ and $h_2$ of the partition 7 are the lowest positions of an upper surface 7*a* and a lower surface 7*b*, respectively, of the partition when the partition 7 is curved in the transverse sectional direction as shown in FIG. 2 so as to partly encircle the lower portion of the first carrying screw 5.

Thus, a developing device capable of preventing degradation of images such as unevenness of density in images can be realized by reducing the unevenness of the developer in the developing device and by supplying the developer to the developing sleeve 8 uniformly in the axial direction.

Second Exemplary Embodiment

Figure 4A:
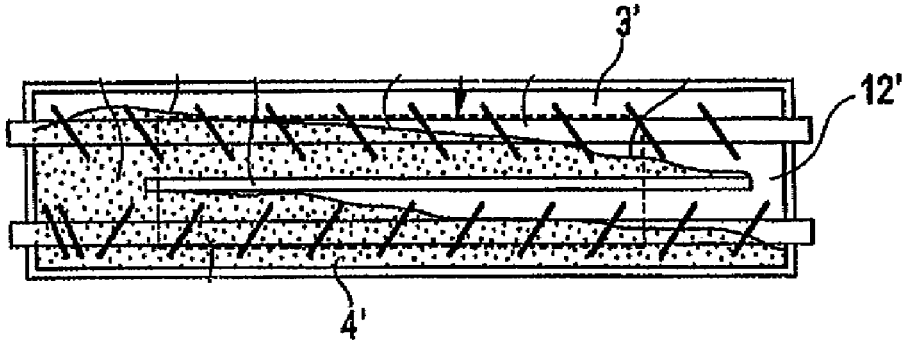
FIG. 4A PRIOR ART
FIG. 4A is a schematic longitudinal sectional view of the known developing device.
Figure 4B:
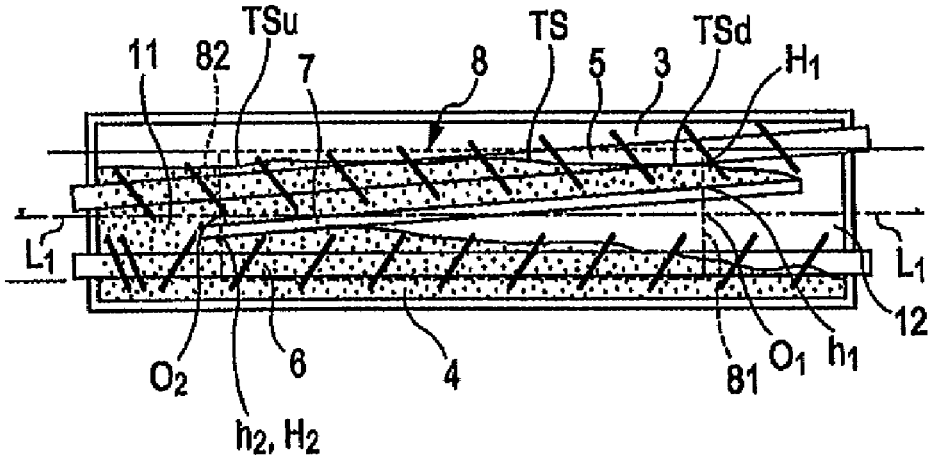
FIG. 4B is a schematic longitudinal sectional view of a developing device according to a second exemplary embodiment of the present invention.

FIG. 4B illustrates a second exemplary embodiment of the present invention. In the first exemplary embodiment, the partition 7 is inclined so as to control the height of the developer surface and the distribution of the developer in the developing chamber 3.

In this exemplary embodiment, the first carrying screw 5 is also inclined along the partition 7 in addition to the partition 7. Structures other than this and effects thereof are the same as those in the first exemplary embodiment. Accordingly, the same reference numerals are used for the same components, and the descriptions thereof will be omitted.

Next, a structure for controlling the height of the developer surface in the developing chamber 3 and the distribution of the developer in the thrust direction according to this exemplary embodiment will be described with reference to FIGS. 4A and 4B. FIG. 4A is a schematic cross-sectional view of the known developing device, and FIG. 4B is a schematic cross-sectional view of a developing device according to this exemplary embodiment.

In the developing device according to this exemplary embodiment, the first carrying screw 5 and the partition 7 are substantially parallel to each other.

According to this exemplary embodiment, the developer raised upward by the pressure from the agitating chamber 4 in the upstream region of the carrying direction in the developing chamber can be carried quickly. As a result, the position of a developer surface TSu in the upstream region in the developing chamber can be lowered as is clear from the comparison between FIGS. 4A and 4B.

Furthermore, the partition 7 is inclined such that the downstream end in the carrying direction of the developer in the developing chamber 3 becomes higher than the other end, and thus the developer is subjected to a carrying force in the direction opposite to the carrying direction by gravity. Moreover, since the position of the partition 7 at the downstream end 81 in the carrying direction in the developing chamber is raised with respect to the developing sleeve 8, the position of a surface TSd of the developer carried downstream in the developing chamber is raised as compared with that of the known technology, and the unevenness of the distribution of the developer in the thrust direction is reduced.

Such a developing device can also reduce the unevenness of the developer in the developing device, and can prevent the degradation of images such as unevenness of density in images by supplying the developer to the developing sleeve 8 uniformly in the axial direction.

Third Exemplary Embodiment

Figure 5A:
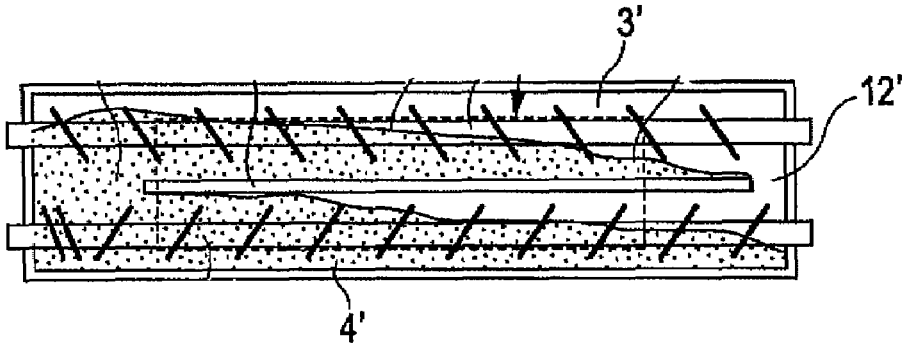
FIG. 5A PRIOR ART
FIG. 5A is a schematic longitudinal sectional view of the known developing device.
Figure 5B:
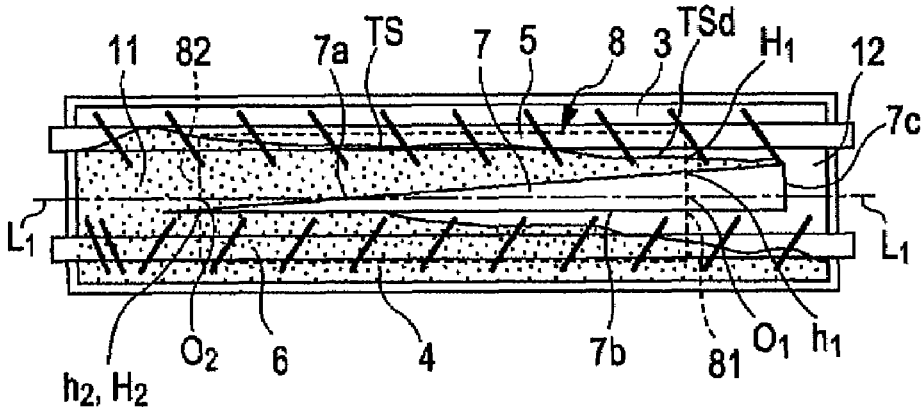
FIG. 5B is a schematic longitudinal sectional view of a developing device according to a third exemplary embodiment of the present invention.

FIG. 5B illustrates a third exemplary embodiment of the present invention.

In the first exemplary embodiment, the partition 7 is inclined so as to control the height of the developer surface and the distribution of the developer in the developing chamber 3.

In this exemplary embodiment, the upper surface 7*a* of the partition 7 is inclined so as to control the height of the developer surface in the developing chamber 3 and the distribution of the developer in the thrust direction.

Structures other than this and effects thereof are the same as those in the first exemplary embodiment. Accordingly, the same reference numerals are used for the same components, and the descriptions thereof will be omitted.

FIG. 5A is a schematic cross-sectional view of the known developing device, and FIG. 5B is a schematic cross-sectional view of a developing device according to this exemplary embodiment.

In the developing device according to this exemplary embodiment, the cross section of the partition 7 in the axial direction of the developing sleeve 8 is a triangle as shown in the drawing, and the upper surface 7*a*, which is the bottom of the developing chamber 3, is inclined such that the downstream end in the carrying direction of the developer in the developing chamber 3 becomes higher than the other end.

With this, the developer raised upward by the pressure from the agitating chamber in the upstream region of the carrying direction in the developing chamber can be carried quickly. As a result, the position of the developer surface TSu in the upstream region in the developing chamber can be lowered.

As described above, the partition 7 is inclined such that the downstream end of the upper surface 7*a* of the partition 7 in the carrying direction of the developer in the developing chamber 3 becomes higher than the other end, and thus the first carrying screw 5 is subjected to a carrying force in the direction opposite to the carrying direction by gravity in the developing chamber 3. Furthermore, since the length of the end face 7*c* of the partition 7 adjacent to the downstream in the carrying direction in the developing chamber is increased with respect to the developing sleeve 8, the position of the surface TSd of the developer carried downstream in the developing chamber is raised compared with that of the known technology, and the unevenness of the distribution of the developer in the thrust direction is reduced.

As a matter of course, the first carrying screw 5 can be inclined along the upper surface 7*a* of the partition 7 as in the second exemplary embodiment.

Such a developing device can also reduce the unevenness of the developer in the developing device, and can prevent the degradation of images such as unevenness of density in images by supplying the developer to the developing sleeve 8 uniformly in the axial direction.

Fourth Exemplary Embodiment

Figure 6:
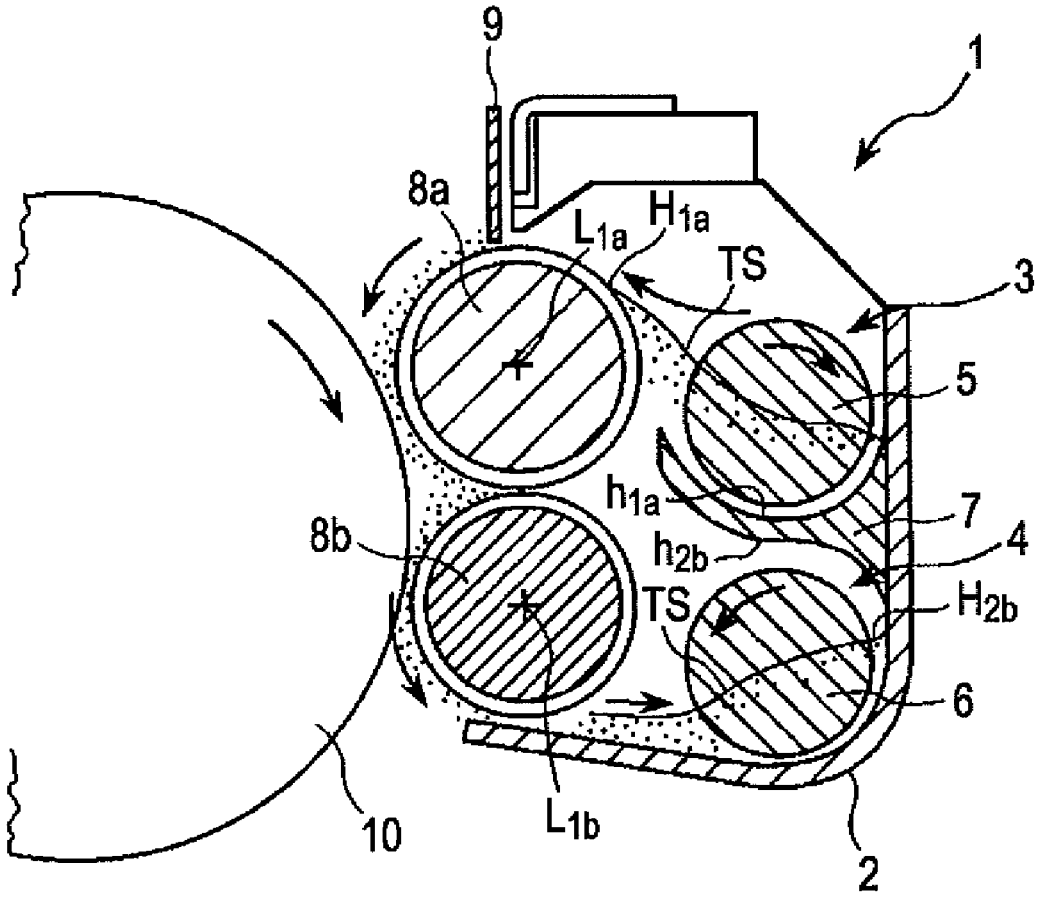
FIG. 6 is a schematic transverse sectional view illustrating a developing device according to a fourth exemplary embodiment of the present invention.
Figure 7A:
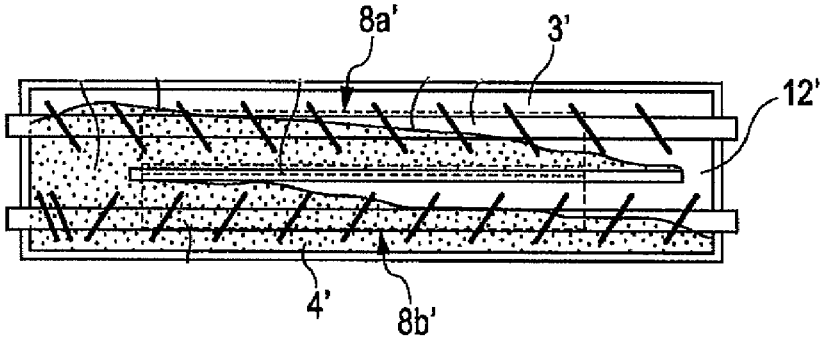
FIG. 7A PRIOR ART
FIG. 7A is a schematic longitudinal sectional view of a known developing device.
Figure 7B:
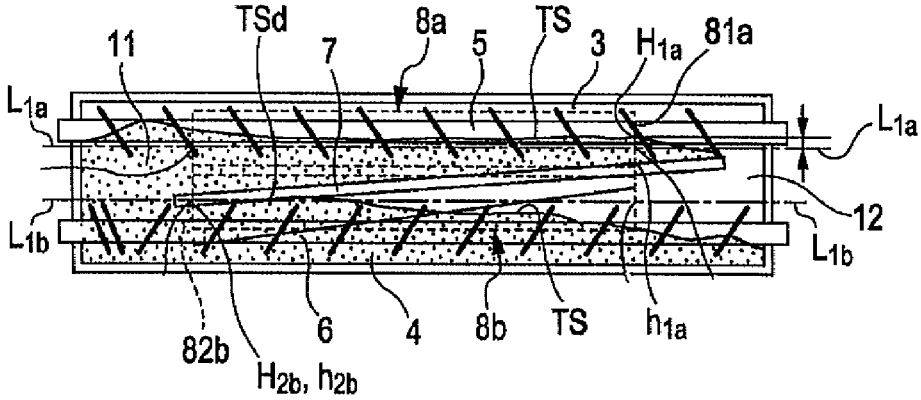
FIG. 7B is a schematic longitudinal sectional view of the developing device according to the fourth exemplary embodiment of the present invention.
Figure 8:
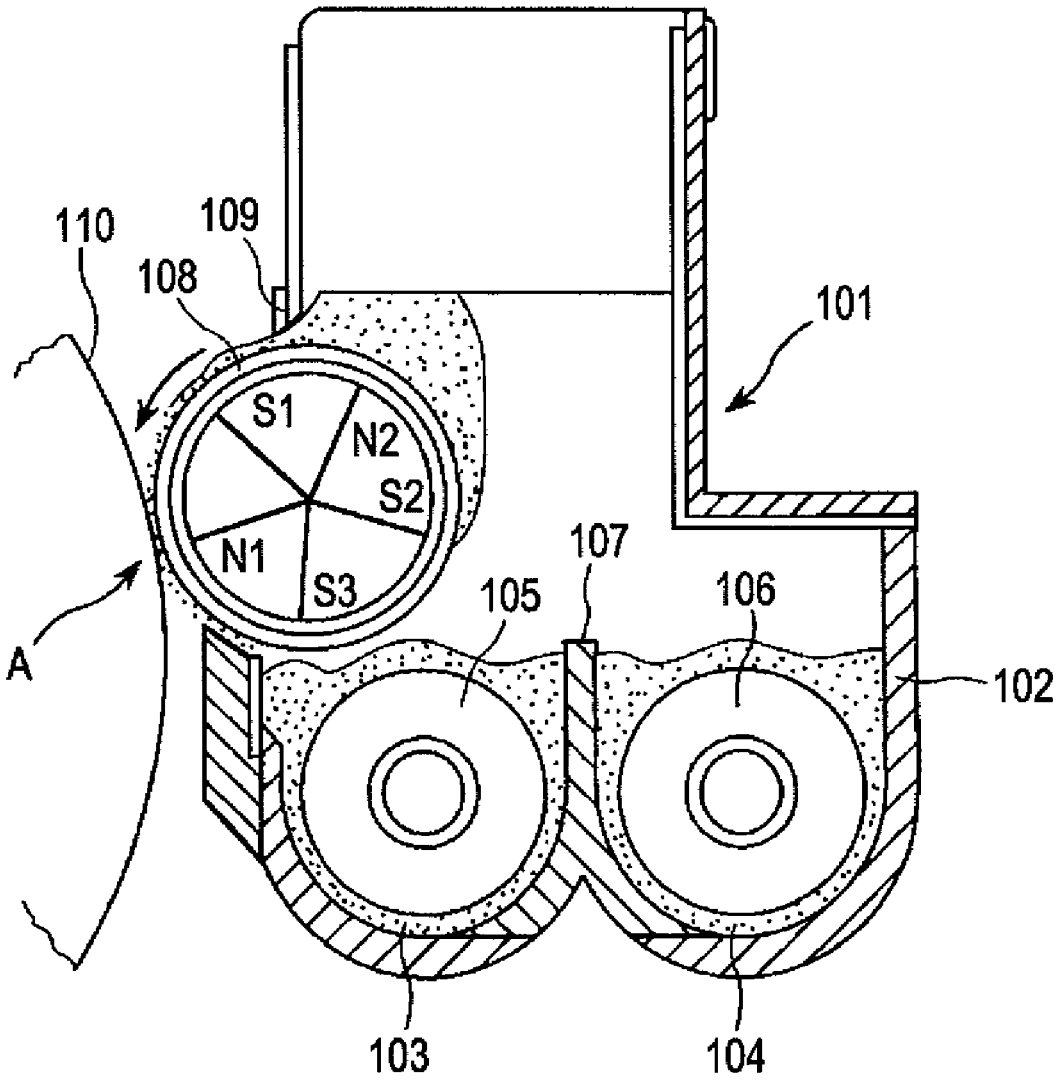
FIG. 8 PRIOR ART
FIG. 8 is a schematic transverse sectional view of a known developing device.
Figure 9:
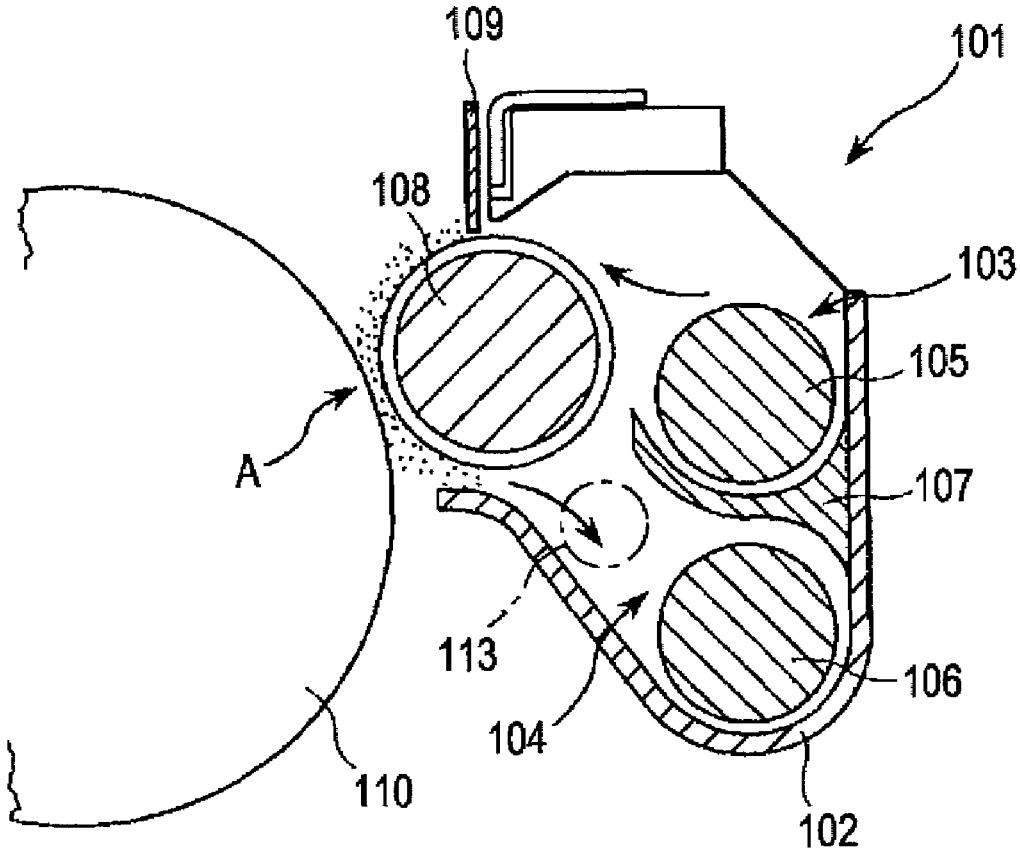
FIG. 9 PRIOR ART
FIG. 9 is a schematic transverse sectional view of another known developing device.
Figure 10:
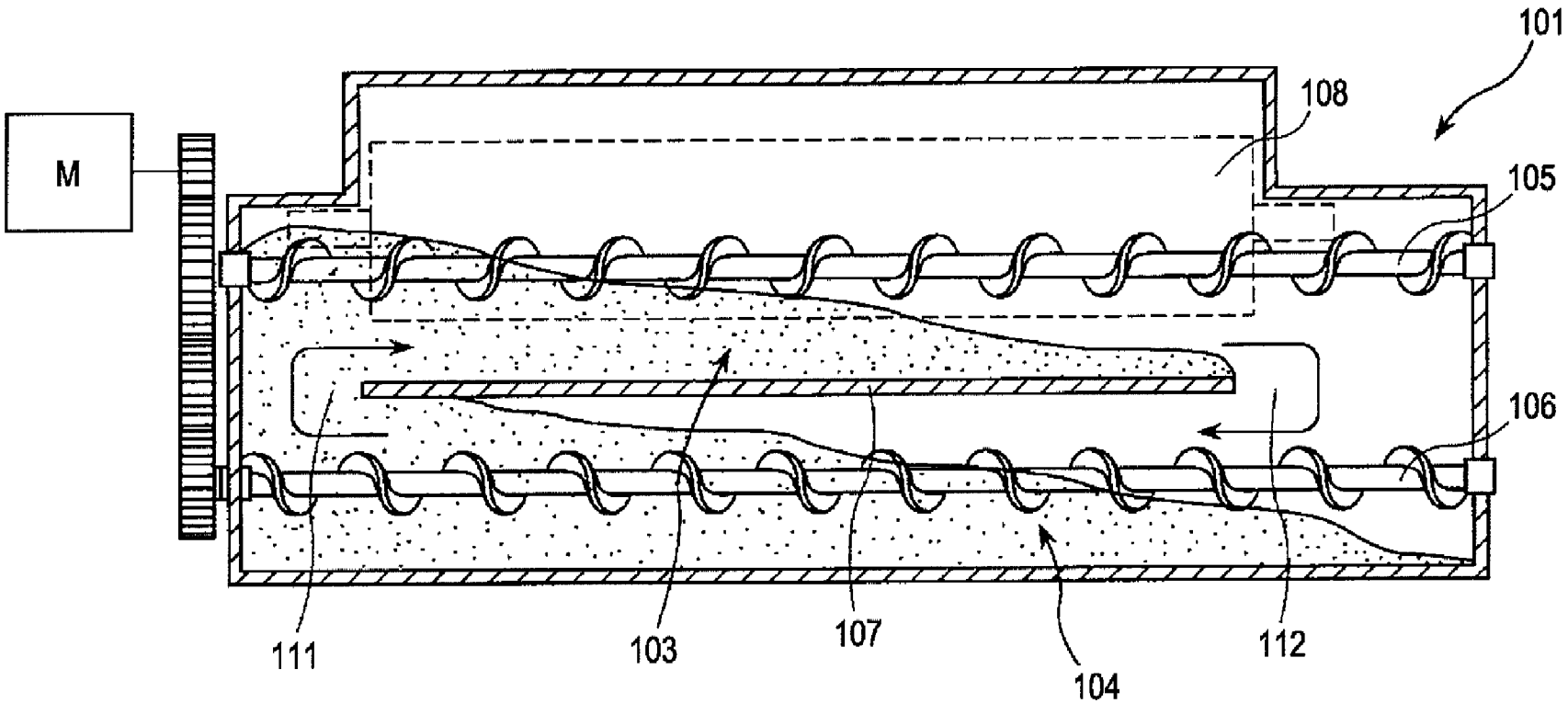
FIG. 10 PRIOR ART
FIG. 10 is a schematic longitudinal sectional view of the known developing device.
Figure 11:
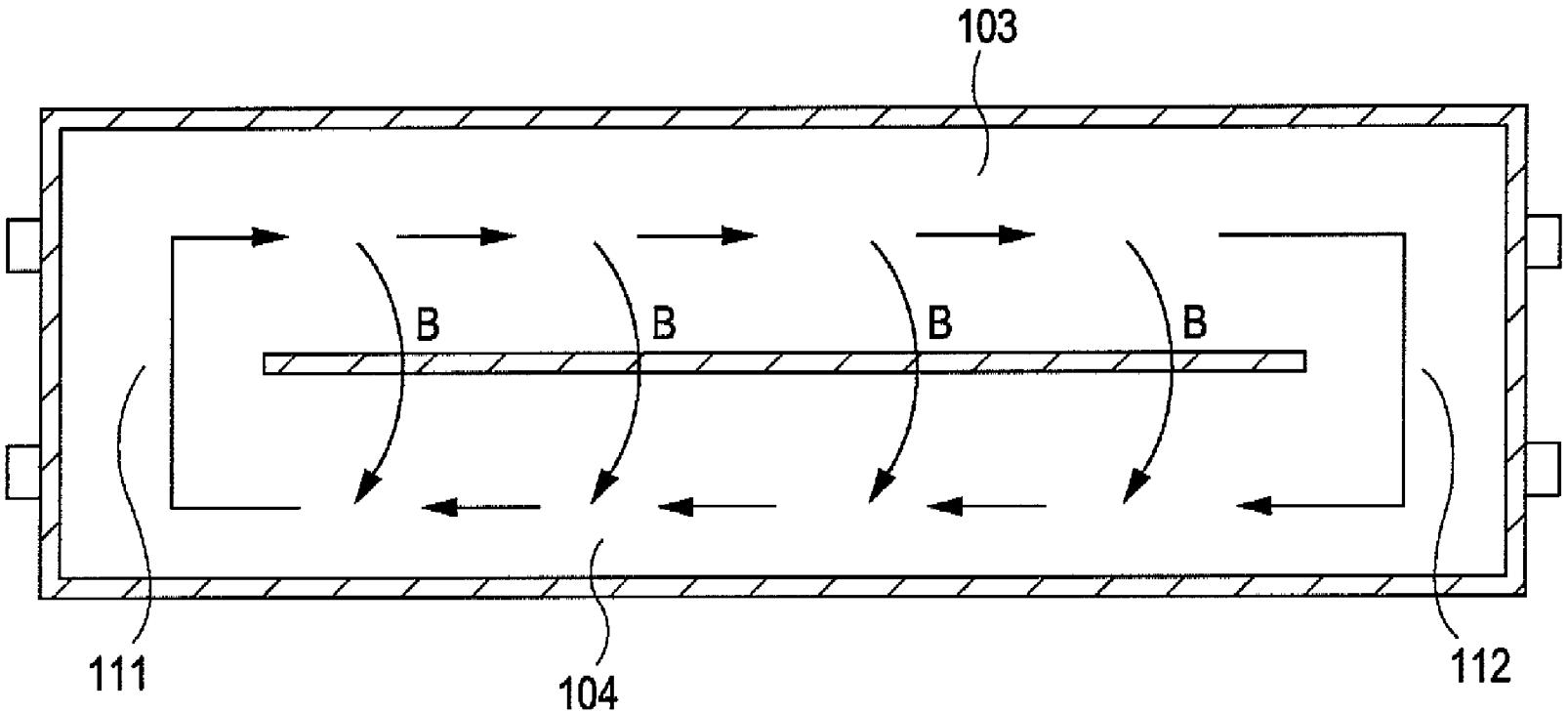
FIG. 11 PRIOR ART
FIG. 11 is a schematic longitudinal sectional view of the known developing device.

FIGS. 6 and 7B illustrates a fourth exemplary embodiment according to the present invention.

In the first exemplary embodiment, the partition 7 is inclined so as to control the height of the developer surface and the distribution of the developer in the developing chamber 3 in the developing device that has only one developing sleeve in the developing chamber.

In this exemplary embodiment, the partition 7 is inclined as in the first exemplary embodiment in a developing device having two developing sleeves.

In this exemplary embodiment, two developing sleeves 8*a* and 8*b* facing the photosensitive drum 10 are disposed substantially in the vertical direction in the developing container 2 as shown in FIG. 6. Structures other than this and effects thereof are the same as those in the first exemplary embodiment. Accordingly, the same reference numerals are used for the same components, and the descriptions thereof will be omitted. However, in this exemplary embodiment, the second carrying screw 6 is rotated in the direction opposite to that of the first carrying screw 5 as shown in FIG. 6 so as to carry the developer in the agitating chamber 4 in the direction opposite to that of the first carrying screw 5. As a matter of course, the structure according to this exemplary embodiment is not limited to this.

FIG. 6 is a transverse sectional view illustrating a schematic structure of the developing device according to this exemplary embodiment, FIG. 7A is a schematic longitudinal sectional view of a known developing device, and FIG. 7B is a schematic longitudinal sectional view of the developing device according to this exemplary embodiment.

In this exemplary embodiment, the two developing sleeves 8*a* and 8*b* are disposed substantially in the vertical direction, and at the same time, the partition 7 that divides the developing container 2 into the developing chamber 3 and the agitating chamber 4 is inclined such that the downstream end in the carrying direction of the developer in the developing chamber 3 becomes higher than the other end.

Figure 12:
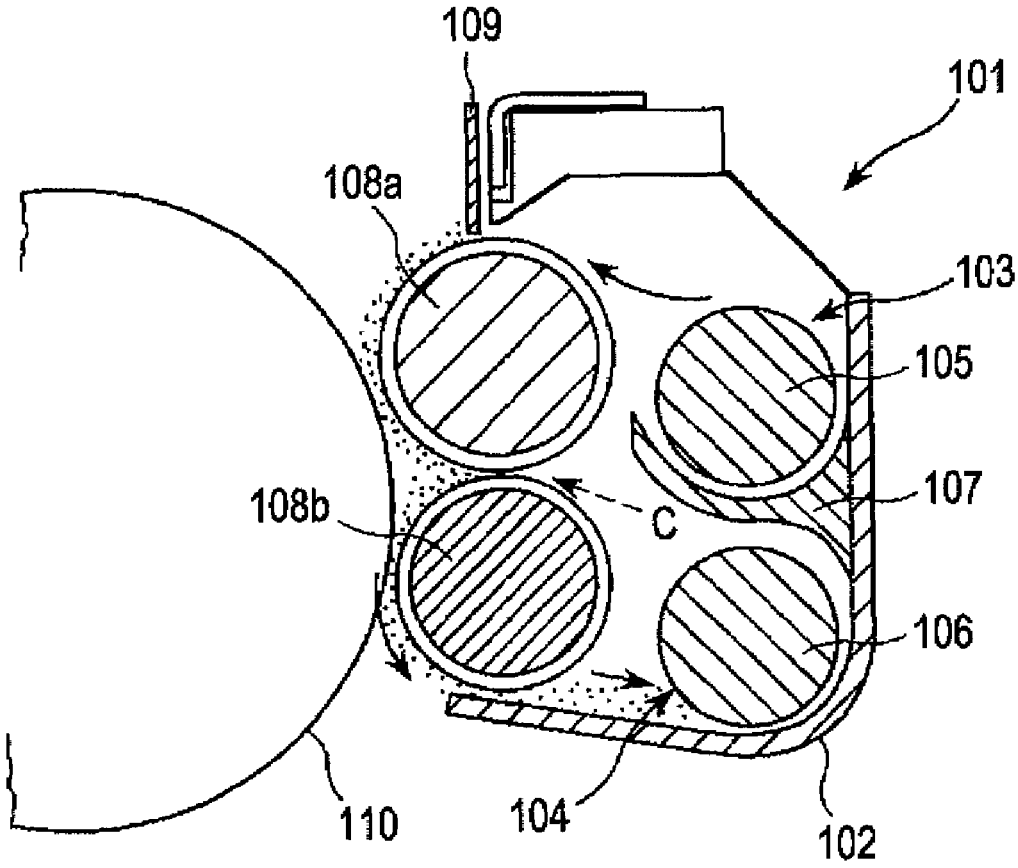
FIG. 12 PRIOR ART
FIG. 12 is a schematic transverse sectional view of another known developing device.

The developing device according to this exemplary embodiment is of the same type as that shown in FIG. 12. In the developing device 101 of this type, the amount of the developer carried by the second carrying screw 106 in the agitating chamber 104 tends to be gradually increased from the upstream end to the downstream end in FIG. 12. Therefore, the developer is supplied from the agitating chamber 104 to the lower developing sleeve 108*b* in the direction of the arrow C at the downstream end in particular, resulting in uneven supply of the developer to the lower developing sleeve 108*b*. This unevenness of the supply to the lower developing sleeve 108*b* may cause degradation of images such as unevenness of density in images in the direction of the sleeve axis.

That is, if unevenness of the developer occurs in the developing chamber 3 and the agitating chamber 4 in a developing device 1 according to this exemplary embodiment shown in FIG. 6, the supply of the developer to the developing sleeve 8*a* becomes uneven due to the unevenness in the developing chamber. Furthermore, in addition to this problem, the developer may be supplied from the agitating chamber 4 to the lower developing sleeve 8*b* at a position where the developer surface in the agitating chamber is high, i.e., in the downstream region of the carrying route in the agitating chamber. As a result, an excessive amount of developer is supplied to the lower developing sleeve at the above-described position. This may lead to an unevenness of density in images, and thus lead to degradation of the images.

However, in the developing device 1 according to this exemplary embodiment, the partition 7 that divides the developing container 2 into the developing chamber 3 and the agitating chamber 4 is inclined such that the downstream end in the carrying direction of the developer in the developing chamber 3 becomes higher than the other end, and thus the unevenness of the developer in the developing chamber is regulated. Furthermore, the partition 7, which also serves as a top board of the agitating chamber 4, is inclined such that the downstream end in the carrying direction becomes lower than the other end in the agitating chamber 4 as shown in FIG. 7B. Thus, the position of the developer surface TSd in the downstream region in the agitating chamber is controlled by the partition 7 so as to be lower than that in the known developing device shown in FIG. 7A with respect to the developing sleeve 8*b*. Therefore, the problem that the developer is supplied also from the agitating chamber 4 to the developing sleeve 8*b* can be solved. With this, the problem of excessive supply of the developer to the lower developing sleeve, which is unique to developing devices of this type having two developing sleeves, can be regulated.

In order to enhance the effects of the developing device according to this exemplary embodiment, a vertical position $H_{1a}$ of the developer surface TS at the downstream end 81*a* of the developing sleeve 8*a* in the carrying direction of the developer in the developing chamber 3 can be located above the central axis line $L_{1a}$ of the developing sleeve 8*a*. A vertical position $h_{1a}$ of the partition 7 at the end 81*a* of the developing sleeve 8*a* is located below the central axis line $L_{1a}$ of the developing sleeve 8*a* in FIG. 7B. However, the position $h_{1a}$ can be located above the central axis line $L_{1a}$ of the developing sleeve 8*a*.

Furthermore, the effect of the developing device according to this exemplary embodiment can be further enhanced by using the structure detailed below. That is, a vertical position $H_{2b}$ of the developer surface TS at the downstream end 82*b* of the developing sleeve 8*b* in the carrying direction of the developer in the agitating chamber 4 can be located below the central axis line $L_{1b}$ of the developing sleeve 8*b*. Furthermore, it is more preferable that a vertical position $h_{2b}$ of the partition 7 at the downstream end 82*b* of the developing sleeve 8*b* be located below the central axis line $L_{1b}$ of the developing sleeve 8*b*.

As a matter of course, the first carrying screw 5 can be inclined along the upper surface 7*a* of the partition 7 as in the second exemplary embodiment. Moreover, as in the third exemplary embodiment, the cross section of the partition 7 can be a triangle as shown in FIG. 5B, and the upper surface 7*a*, which is the bottom of the developing chamber 3, can be inclined such that the downstream end in the carrying direction of the developer in the developing chamber 3 becomes higher than the other end.

Such a developing device can reduce the unevenness of the developer in the developing device, and can prevent the degradation of images such as unevenness of density in images by supplying the developer to the developing sleeves 8*a* and 8*b* uniformly in the axial direction. Furthermore, degradation of images such as unevenness of density in images caused by the excessive supply of the developer to the developing sleeve 8*b* can be prevented by controlling the height of the developer surface in the agitating chamber 4.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the priority of Japanese Patent Application No. 2005-359625 filed Dec. 13, 2005, which is hereby incorporated by reference herein in its entirety.

What is claimed is:

1. A developing device comprising:

a developing container adapted to accommodate developer;

a rotatable developer-bearing member disposed in the developing container and supporting the developer for developing electrostatic images;

a first chamber provided in the developing container for supplying the developer to the developer-bearing member;

a second chamber provided in the developing container below the first chamber;

a partition disposed between the first chamber and the second chamber;

a first communicating portion disposed at one end of the first chamber and the second chamber in the longitudinal direction and connecting the first chamber and the second chamber;

a second communicating portion disposed at the other end of the first chamber and the second chamber in the longitudinal direction and connecting the first chamber and the second chamber;

a first carrying member disposed in the first chamber and configured to carry the developer in the first chamber in a first carrying direction from the first communicating portion to the second communicating portion; and a second carrying member disposed in the second chamber and configured to carry the developer in the second chamber in a second carrying direction from the second communicating portion to the first communicating portion, wherein a bottom portion of the first chamber is inclined such that an end of the bottom portion to the downstream in the first carrying direction is higher than the other end at a position where the bottom portion faces the developer-bearing member.

2. The developing device according to claim 1, wherein a surface of the developer in the first chamber is located above a rotational axis of the developer-bearing member at a position where the surface faces a downstream end in the first carrying direction of a maximum developer-supporting area of the developer-bearing member along the rotational axis.

3. The developing device according to claim 2, wherein a surface of the developer in the second chamber is located below the rotational axis of the developer-bearing member at a position where the surface faces a downstream end in the second carrying direction of the maximum developer-supporting area of the developer-bearing member along the rotational axis.

4. The developing device according to claim 1, wherein an upper surface of the partition defines the bottom portion of the first chamber, and wherein the upper surface of the partition at a downstream end in the first carrying direction is located above a rotational axis of the developer-bearing member.

5. The developing device according to claim 4, wherein a lower surface of the partition defines a top portion of the second chamber, and the lower surface of the partition at a downstream end in the second carrying direction is located below the rotational axis of the developer-bearing member.

6. The developing device according to claim 1, further comprising a second developer-bearing member disposed below the developer-bearing member and adjacent to the second chamber.

7. The developing device according to claim 6, wherein a surface of the developer in the second chamber is located below a rotational axis of the second developer-bearing member at a position where the surface faces a downstream end in the second carrying direction of a maximum developer-supporting area of the second developer-bearing member along the rotational axis.

8. The developing device according to claim 6, wherein a lower surface of the partition defines a top portion of the second chamber, and the lower surface of the partition at a downstream end in the second carrying direction is located below the rotational axis of the developer-bearing member.

* * * * *